US007645399B2

(12) United States Patent
Tarnawskyj et al.

(10) Patent No.: US 7,645,399 B2
(45) Date of Patent: Jan. 12, 2010

(54) ELECTROCONDUCTIVE COMPOSITION

(75) Inventors: Ihor W. Tarnawskyj, Webster, NY (US); Joseph A. Swift, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 303 days.

(21) Appl. No.: 11/139,688

(22) Filed: May 31, 2005

(65) Prior Publication Data

US 2006/0269864 A1 Nov. 30, 2006

(51) Int. Cl.
*H01B 1/06* (2006.01)

(52) U.S. Cl. ..... 252/510; 428/212; 429/34

(58) Field of Classification Search ..... 252/500, 252/325, 510, 511; 427/212; 428/88, 212; 399/90; 205/152, 419; 429/34
See application file for complete search history.

(56) References Cited

U.S. PATENT DOCUMENTS

| | | | | | |
|---|---|---|---|---|---|
| 4,257,699 | A | | 3/1981 | Lentz | |
| 4,738,757 | A | * | 4/1988 | Naarmann | 205/152 |
| 4,781,971 | A | * | 11/1988 | Marikar et al. | 428/212 |
| 4,798,685 | A | | 1/1989 | Yaniger | |
| 4,806,271 | A | * | 2/1989 | Yaniger et al. | 252/500 |
| 4,940,517 | A | * | 7/1990 | Wei | 205/419 |
| 5,008,041 | A | * | 4/1991 | Cameron et al. | 252/500 |
| 5,017,432 | A | | 5/1991 | Eddy et al. | |
| 5,061,965 | A | | 10/1991 | Ferguson et al. | |
| 5,069,820 | A | | 12/1991 | Jen et al. | |
| 5,079,037 | A | * | 1/1992 | Morrison et al. | 427/212 |
| 5,139,862 | A | * | 8/1992 | Swift et al. | 428/299.1 |
| 5,276,112 | A | * | 1/1994 | MacDiarmid et al. | 525/540 |
| 5,278,213 | A | | 1/1994 | Han et al. | |
| 5,498,372 | A | * | 3/1996 | Hedges | 252/511 |
| 5,794,100 | A | * | 8/1998 | Bell et al. | 399/90 |
| 5,812,908 | A | * | 9/1998 | Larocca et al. | 399/90 |
| 5,843,567 | A | * | 12/1998 | Swift et al. | 428/221 |
| 5,885,683 | A | * | 3/1999 | Swift | 428/88 |
| 6,132,645 | A | * | 10/2000 | Hedges | 252/510 |
| 6,214,921 | B1 | * | 4/2001 | Bluett et al. | 524/495 |
| 6,265,046 | B1 | * | 7/2001 | Swift | 428/88 |
| 6,391,509 | B1 | | 5/2002 | Drappel et al. | |
| 6,605,236 | B1 | | 8/2003 | Smith et al. | |
| 2003/0129471 | A1 | * | 7/2003 | Kitade et al. | 429/34 |
| 2003/0144388 | A1 | | 7/2003 | Swift et al. | |

* cited by examiner

*Primary Examiner*—Mark Kopec
*Assistant Examiner*—Khanh Tuan Nguyen
(74) *Attorney, Agent, or Firm*—MH2 Technology Law Group LLP

(57) ABSTRACT

An electrical component including an electrically conductive composition including a pyrrolized carbon-based material coated with a conductive polymer is disclosed.

12 Claims, No Drawings

ELECTROCONDUCTIVE COMPOSITION

FIELD OF THE DISCLOSURE

The present disclosure relates to an electrical component comprising an electrically conductive composition comprising a pyrrolized carbon-based material coated with a conductive polymer.

BACKGROUND OF THE DISCLOSURE

In electophotography, there is a common need for inexpensive, easily fabricated, resistive polymeric matrix compositions, such as films or resins, etc., such as for use in electrical contacts, electromechanical contacts, electrostatic contacts, and devices, which vary over a substantial resistance range. The resistance of the films as well as the surfaces they provide can be changed by varying the quantity of conductive material dispersed in an insulating binder. A greater resistance can be achieved by lower loadings of the selected conductive material, where small decreases at the percolation threshold in loading of conductive materials can cause dramatic increases in resistance. Typically, such materials have a surface resistivity in the range from about $10^2$ ohms/square to about $10^8$ ohms/square and a thickness in the range from about 10 nanometers to about 1 millimeter. For example, thin films having a resistivity targeted at a desired value within such ranges can be used to overcoat other materials to comprise a multiple-layer component. As a result, the surface layer of such a coated component can exhibit for example static discharge, electrostatic bleed-off behaviors, current conduction, resistive heating, and other similar characteristics. However, it can be difficult to precisely control and maintain films or resin based composites associated with known resistivity values or resistivity ranges due to the occurrence of sudden resistance changes that can be caused by improper selection of material compositions used to make the subject films or resin composites and which occur at, or near specific percolation thresholds which are known to represent a particularly sensitive region of the resistivity-filler loading spectrum. Dramatic increases or even decreases in resistance can be observed when conductive particles or fillers are incorporated into such composite materials, which render material composites conductive and then become subjected to external or internal forces that cause a change in the initial relationship, such as particle-to-particle distance or effective fill density that exists between the conductive filler and host. The host can be a polymeric resin such as a plastic or elastomer, a ceramic or glass, a metal, or combinations thereof. An example of an external force that can cause an effective change in the resistivity of a filled composite is a compressive force of such magnitude to cause significant compression or density change in the composition. Thermal or humidity induced swelling can also cause such instabilities.

Conductive particles have been loaded in composites in varying quantities to control resistance levels. For example, light loadings of conductive particles, for example <30% by weight, have been added to insulating host matrices, such as polymers in attempts to achieve a target resistivity value. Naturally, it is desirable to eliminate dramatic changes in resistance that can occur over the functional life of the related device, which can be further complicated when the target resistance value falls at, or close to a percolation threshold. In addition, the ability to precisely control all of the material properties of such a composite can be hampered by inhomogeneities that result from poor dispersion of small size fillers and low material amounts to a host matrix polymer. To reduce this effect, filler materials that are relatively less conductive have been used at relatively high loadings. For example, various metal, metal oxide containing particles, and carbon black particles with volume resistivities selected to represent the higher end of the available resistivity range have been used in attempts at achieving good solid-stage dispersion and tightly controlled electrical resistivities. However, high loadings of particles in a thin film can cause other unwanted effects, for example they are known to make the film hard or brittle or can cause low toughness and tear strength properties.

An example of the need for resistive compositions with controlled electrical properties can be found in corona charging devices, such as scorotrons. However, the device suffers from a number of problems. Any differences in the microstructure of the pins causes each pin to form a corona at a slightly different voltage. Once a corona forms at the end of a pin, the voltage on the array of pins drops, because the corona sustaining voltage is less than the corona onset voltage. The drop in voltage prevents other pins from forming a corona. This self-limiting behavior can be overcome by including current-limiting resistances between each pin and the bus bar which supplies the high voltage to all of the pins in the array. However, it is difficult to control the individual distributed resistances between the pins and bus, because the required resistivity for such devices is generally at the edge of the percolation threshold for most materials. Any small, local changes in composition result in large changes in resistivities making it difficult to obtain a precisely controlled and uniform resistivity across all of the thin film resistors that are in a large population.

A general example of the need for resistive matrix compositions having tightly controlled resistivity values can be found in simple voltage sensors for electrostatically charged surfaces. A high voltage sensor fabricated with a resistive film having a desired target circuit resistance bleeds only a small quantity of charge from a surface leaving the charge density nearly unchanged. The need for the disclosed resistive compositions can also be found in document sensing devices in xerographic copying machines. As a document or paper passes between an electrical contacting brush and a resistive film, the resistance of the circuit is changed.

In general, desired resistivity of a conductive composition can be achieved by controlling the type, shape, and loading of the conductive particles and/or other filler materials. Very small changes in the loading of conductive filler materials near a threshold value at which bulk conduction occurs, i.e., the percolation threshold, can cause dramatic and unwanted changes in a composition's conductivity. Furthermore, differences or variations in particle chemical composition, form, size and shape can cause variations in conductivity at even a constant weight loading. Moreover, the relative change in resistivity with filler loadings is generally less with loadings substantially above the percolation threshold. However this generally requires sufficiently high concentrations of conductive particles, in order to assure conductive particle-to-particle contacts to effectively span the thickness of the composite. The percolation threshold is effectively achieved at the point where a first continuous particle chain is formed and results in an extremely large change in conductivity with respect to incremental changes in filler loading. Clearly, in the case where there is only one continuous chain that establishes the threshold, any change to the continuity of this chain will have a dramatic effect on the resultant conductivity In order to assure that a sufficient number of chains exist and in order to assure that the subject composition has a generally stable electrical resistivity, often a larger than necessary fill loading is employed in the composition. As a result the relative cost of the filler, which is often more expensive than the host matrix material, can dominate the overall cost of the composite. Generally lower filler loadings are desired from an economic perspective.

In general, the current-voltage response of a particle-filled composite is an important design consideration for electric circuits and related devices that employ such composites. A linear current-voltage response is known in the art as "ohmic" or also described as obeying Ohms law. Similarly, non-linear current-voltage responses are referred to as "non-ohmic". It is known that many conductive particle filled polymer composites, for example carbon black filled plastics, behave non-ohmically when subjected to a variable applied voltage. Since many commercial devices are subjected to operational situations that require variable applied voltages, often varying by hundreds or even thousands of volts, the non-linear response is an undesired characteristic that complicates the device design and adds unnecessary design and product costs.

As conventionally known in the art, conductive filler materials generally have DC volume resistivity values from less than about $10^{-3}$ to about $10^{-6}$ ohm-cm, while insulating materials, on the other hand, generally have resistivity values of greater than about $10^{13}$ ohm-cm to about $10^{16}$ ohm-cm. "Controlled conductivity" materials having intermediate resistivities can have resistivity values ranging from about $10^{-3}$ ohm-cm to about $10^{13}$ ohm-cm.

SUMMARY OF THE DISCLOSURE

In various aspects of the disclosure, there is provided an electrical component comprising an electrically conductive composition comprising a pyrrolized carbon-based material coated with a conductive polymer; an electrically conductive material comprising a pyrrolized carbon-based material coated with a conductive polymer; and a process comprising mixing the pyrrolized carbon-based material with a mixture of monomer, conductive polymer, and initiator; and polymerizing the monomer by heating.

Additional objects and advantages of the disclosure will be set forth in part in the description which follows, and can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EMBODIMENTS

An electrical component can be represented by a variety of electrical devices for conducting electrical current, such as switches, sensors, connectors, interlocks, and the like. Other electrical components that can be produced in conjunction with the present disclosure, such as in an electrophotographic system, which can also be provided for, include electrophotographic process components, such as intermediate transfer belts, bias transfer belts, bias charging belts, developer rolls, developer belts, bias transfer rolls, fuser rolls, pre- and mid-heater belts, fuser belts, pressure rolls, donor rolls, and bias charging rolls.

Typically these devices can be low energy, electrostatic devices, using voltages within the range of millivolts to kilovolts and currents within the range of microamps to milliamps, as opposed to high power applications of hundreds to thousands of amperes.

Although the present disclosure can be used in certain applications in the microamp to tens of amps region, it is noted that results can be obtained in high resistance circuitry where power losses attributable to the subject devices can be tolerated. It is also noted that these devices can be used in certain applications in the very high voltage region in excess of about 5,000 volts to about 10,000 volts, for example, where undesirable electrostatic potentials can be generated by triboelectric forces.

The electrical component of the present disclosure can comprise a composition, which can comprise an electrically conductive material of the present disclosure, which can be present in a host matrix material. In one aspect of the disclosure, the composition can have electrically conductive or insulating properties based upon the electrical or insulating properties of the electrically conductive and host matrix materials. The electrically conductive material can be present in the composition in any desired or effective amount, for example from about 0.01% to about 50%, and as a further example from about 2% to about 10%, by weight of the electrically conductive composition. The disclosed composition can be stable at a temperature ranging from about −50° C. to about 300° C., for example from about −25° C. to about 200° C., and as a further example from about 0° C. to about 100° C.

The electrically conductive material can be in any desired or effective form, such as fibers, fillers, and powders. The shape of the powder form can be controlled to form fine powders in different forms, such as a spiracle powder, a near spiracle powder, a short-length rod powder, spheres, near spheres, flakes, needles, shards, rods, and mixtures and blends thereof.

To obtain electrically conductive material having a submicroscopic size, the material can be subjected to conventionally used methods including, but not limited to, mechanical chopping, grinding, cryogenic grinding, milling, micro-milling, and other high shear attrition methods. Non-limiting examples of conventional grinding techniques include ball milling with steel shot, high sheer mixing, attrition, wrist shakers with steel shot, and paint shakers with steel shot. In one aspect of the present disclosure, the electrically conductive material can be ground by conventional grinding techniques in the presence of at least one liquid, such as a solvent, or even a liquefied gas, such as liquid nitrogen. The use of a liquid phase in such a process can act as a heat dissipant and as a coolant during mechanical grinding, further facilitating formation of powders having more uniform or consistent particle size and shape, without particle aggregation. In this manner, progressive grinding in a liquid of larger particles ultimately can result in the production of progressively finer particles suitable for use herein. Even pre-cut fibers, such as fibers of approximately one centimeter in length, can be ground in the presence of a suitable organic liquid, such as a solvent or in a liquefied gas. A liquefied gas suitable for use herein includes, but is not limited to, carbon dioxide or nitrogen, which can also provide favorable cryogenic conditions for the milling of fine powders. Alternatively, the powder can be produced from larger size forms by a technique known as laser micro-maching.

A liquid or liquid suitable solvent for use herein includes, but is not limited to, pyridine, cyclohexanone, toluene, acetone, dimethylsulfoxide (DMSO), acetonitrile, p-dioxane, methylene chloride, tetrahydrofuran (THF), methanol, dimethylamide, 2-methylbutane, 1,1,1-trichloroethane, propanol, diethyl amine, chloroform, methylethylketone (MEK), methylisobutylketone (MIBK), carbon tetrachloride ($CCl_4$), water, and mixtures thereof, such as MEK/toluene/water and MEK/toluene. If water is used, a surfactant or wetting agent can be added to improve the dispersion of powder in the liquid as the powder is formed.

In another aspect of the present disclosure, the use of a different electrically conductive material, including the use of differently sized and shaped electrically conductive material in the composition can provide a way for controlling chemical, physical, electrical, and mechanical properties of the composition or combinations thereof and the electrical component comprising the composition. For example, the use of a metallic material having magnetic properties can alter the magnetic properties of the composition and/or the electrical component comprising the composition. Moreover, the orientation of electrically conductive material, such as in the form of a fiber or powder, in a host matrix material can enable tight resistivity control, when compared to those conventionally used in the art, where control within several, or perhaps even a few, orders of magnitude can be considered normal. As a further example, the electrically conductive material and/or host matrix material can be chosen based upon its chemical inertness relative to other materials in the composition, short process or cure times, and/or specific electrical resistivity values. Moreover, if a difference in cross directional electrical conduction within an insulating matrix material is desired, directional alignment of the electrically conductive material, such as a filler, can be chosen such that packing density of the material along one direction is relatively high with respect to the other direction(s). For example, the material and matrix material can be compressed or stretched along one dimension during the crosslinking or solidification of the composition during the final stages of fabrication resulting in somewhat differential resistivities along the respective directions.

In one aspect of the present disclosure, short fibers, which can be in powder form, can be used to enable the coating of a uniform host matrix, such as a film having a thickness from about one micron to about 1 millimeter. The fibers can have a submicroscopic fiber length less than about 25 microns, for example from about 10 nanometers to about 5 microns, and as a further example from about 0.01 micron to about 0.5 micron. The fibers lengths in general should be no greater than the coated film thickness in the case where the smoothness of the surface can be an important factor. Otherwise, longer fiber lengths, such as fiber lengths greater than the film thickness for example about 1 micron to about 25 microns can be used as a means to control the resistivity of the composite and influence the surface topography.

Suitable electrically conductive material for use herein includes all of those materials that can be modified to conduct current under the influence of an applied field. The suitable conductive material includes, but is not limited to, non-metallic materials, polymeric materials, metallic materials, hydrocarbons, amines, epoxides, phenols, phenylene oxides, phenoxy resins, cellulose, tetracyanoquinodimethane (TCNQ) salt, phthalocyanine, glass, metal-coated glass including metal-plated glass, metal particles containing glass, metal oxides, doped metal oxides, intrinsically conductive polymers, ceramic fibers, and organic fibers.

The term "nonmetallic" is used to distinguish from conventional metal material which can exhibit metallic conductivity having resistivity on the order of $1\times10^{-3}$ ohm-cm to about $1\times10^{-6}$ ohm-cm. Nonmetallic material can be treated in ways to approach or provide metal-like properties, which include electrical conductivity, thermal conductivity, and magnetic activity. For example, nonmetallic material can be used that has a DC volume resistivity from about $2\times10^{-5}$ ohm-cm to about $1\times10^{13}$ ohm-cm, for example from about $1\times10^{-3}$ ohm-cm to about $1\times10^{11}$ ohm-cm. The nonmetallic material can exhibit at least one of the following properties: conduct current, dissipate excess or unwanted electrostatic build up, minimize resistance losses, and suppress radio frequency interference of a component employing such material.

Suitable nonmetallic materials for use herein can include, but are not limited to, natural and synthetic polymers, such as polyacrylonitrile (PAN), rayon, silk, wool, and cotton, carbon, carbon-based fibers, such as carbon-graphite fibers, carbon coated ceramic materials, blends thereof, and the like, which can or can not undergo pyrolysis, further pyrolysis, or partial pyrolysis under controlled conditions. Examples of suitable carbon-based fibers include, but are not limited to carbon coated-glass, metal/carbon-plated glass, carbon particle filled glass, carbon-ceramic materials, carbon-coated ceramic materials, carbon containing ceramic materials, and organic fibers. Alternately, conductive materials including boron nitride (BN) and boron carbon nitride (BCN) as well as doped silicon can be used in the present disclosure.

A suitable electrically conductive material can be a pyrrolized, such as a partially pyrrolized, carbon-based material. The term "partially" is understood to mean anything less than 100% pyrrolized, such as about 90% pyrrolized, for example, about 80% pyrrolized, and as a further example from about 70% pyrrolized. An example of a partially pyrrolized carbon-based material is partially pyrrolized polyacrylonitrile ("PAN") which is prepared from suitable PAN precursor fibers. Polyacrylonitrile based carbon fibers are commercially available as continuous filament tows having, for example, 1, 3, 6, 12, or up to 160 thousand filaments per tow. Examples of commercially available PAN fibers produced in bundles of about 1,000 to about 160,000 filaments have been made and distributed by Akzo Nobel Fortafil Fibers, Zoltek Corp., BP Amoco, and others. Alternatively, those yarn bundles, or "tows", i.e., another term for carbon fibers produced in bundles of about 1,000 to about 160,000 filaments, can be partially pyrrolized in a two-stage process involving stabilizing the PAN fibers at temperatures on the order of 300° C. in an oxygen atmosphere.

In accordance with the present disclosure, a wide range of resistivities can be achieved via use of such partially pyrrolized PAN fibers by temperature and time controlled heat processing. Such processing can involve careful control of pyrolization temperatures and heat exposure times within certain limits resulting in the production of pyrrolized carbon fibers with precise electrical resistivities. During the first processing stage "preox"-stabilized PAN fibers can be produced, which are intermediate fibers that can be black in color, relatively large in diameter, and nonconductive. This can be followed by a second or intermediate stage of processing, where further pyrolization processing of the "pre-ox" fibers at progressively elevated temperatures in an inert (for example, nitrogen) atmosphere can produce intermediate level materials with specific physical, chemical, electrical or mechanical properties, such as a wide range of resistivity values. At high processing temperatures, which can be in a range from about 600° C. to about 3000° C. used for the conversion of such polyacrylonitrile fibers, a mechanically strong and chemically inert fiber, having about 85% to about 99.99% elemental carbon can be produced that can resist chemical attack and oxidation.

In the present disclosure, pyrrolized PAN fibers can be formed into a powder form by any suitable conventional mechanical grinding means to convert fibers into powders. The pyrrolized carbon-based powders, such as partially pyrrolized PAN powder, can have any suitable particle size (e.g., 1 nanometers to 100 microns) and particle shape in a concentration suitable to render the desired properties in the resultant composition. The pyrrolized carbon powder, which can be spherically shaped and/or a fine powder, can have a particle size from about 0.001 micron to about 10 microns, and for example less than about 0.9 micron or can have a cross section diameter from about 1 microns to about 50 microns, where the length to cross-sectional diameter ratio is about 0.1 to about 100.

In another aspect of the present disclosure, the polymer from which the pyrrolized carbon-based material is prepared can be used as a host matrix material and can comprise from about 0.1% to about 99% by weight, and for example from about at least 2% to about 50% by weight pyrrolized carbon powder filler.

In accordance with the present disclosure, the DC electrical resistivity of the pyrrolized carbon-based material can be controlled by the selection of the temperature of pyrolization where carbon fibers having DC resistivities of $10^{-2}$ ohm-cm to about $10^{-4}$ ohm-cm result from treatment temperatures of up to about 1800° C. to about 3000° C., while a resistivity of about $10^{4}$ to about $10^{8}$ can be achieved if the pyrrolization temperature is controlled in the range from about 500° C. to about 750° C. Similarly, other such pyrrolized carbon-based material can be produced having a DC volume resistivity from about $1\times10^{-5}$ ohm-cm to about $1\times10^{13}$ ohm-cm, for example from about $1\times10^{-3}$ ohm-cm to about 1000 ohm-cm by controlling the temperature of the second stage pyrrolization process from about 300° C. to about 1800° C.

The electrically conductive material disclosed herein, which can be produced as a result of high temperature processing, and can be stable at high temperatures, can make these materials compatible with a variety of host matrix materials, including polymers and non-polymers.

Any suitable host matrix material can be employed in the practice of the present disclosure. In one aspect of the disclosure, a polymeric matrix material can have a specific gravity from about 1.1 gm/cm$^3$ to about 1.5 gm/cm$^3$, foamed polymers can have a specific gravity less than about 1.1 gm/cm$^3$, while the fibers and related powder forms can have a specific gravity from about 1.5 gm/cm$^3$ to about 2.2 gm/cm$^3$. The terms "density" and "specific gravity" are intended to have the same meaning and are used interchangeably throughout this application. Furthermore for example, extremely high fiber particle concentrations, which can be greater than 50% by weight and often greater than 75%, by weight result in specific gravities of a composition dominated by the filler, which have specific gravity values that fall significantly above that of the unfilled matrix. Such high density composites or compositions can be useful for achieving high electrical and high thermal conductivity for use in the disclosed electrical component. Moreover, low density characteristics of the host matrix material can be useful in applications where total weight of the component is important.

Resistive polymeric matrix materials suitable for use herein can be selected from the various polymeric materials and can be homopolymers or copolymers and can comprise a thermoplastic resin a thermosetting resin, or blends or mixtures thereof. The matrix can comprise a single constituent, or alternatively, the matrix can comprise more than one resin appropriately mixed or blended to result in the desired combination of properties achieved by mixing. A solution can be used to achieve phase intermixing of various ingredients. For example, a selected host matrix material having a given intrinsic resistivity can be mixed with two different, compatible insulating binder polymers in solution. When a matrix is formed and dried from such dispersion, a well-connected array of fiber particles can exist throughout the polymer film sufficient to produce a DC resistivity of the composite film of the desired value. Further, the fibers or powders tend to reinforce the polymer binders to produce a stronger and more durable film. Alternatively, short powder fibers having an intrinsic resistivity that is selectable over many orders of magnitude are mixed with an insulating prepolymer such as monomers, oligomers, or mixtures of monomers and oligomers, and with polymerization initiators such that the fibers and prepolymer have approximately equal volumes. For example, when a matrix is formed and cross linked or cured from such a mixture, a well-connected array of fibers, fillers or corresponding powder forms can extend throughout the polymer matrix that is polymerized in the presence of the filler.

Examples of matrix resins suitable for use herein also can be selected from thermoplastic and thermosetting resins. Polymers suitable for use herein include and carbon, hydrogen, silicon, or oxygen containing polymer including, but are not limited to, polyesters, polyamides, polyvinyls, poly-cellulose derivatives, fluoroelastomers, polysiloxanes, polysilanes, polycarbazoles, polyphenothiazines, polyimides, polyetherketones, polyetherimides, polyethersulphones, polyurethanes, polyether urethanes, polyester urethanes, polyesters, polytetrafluoroethylenes, polycarbonates, polyacrylonitriles and copolymers and mixtures thereof of the above. Examples of co-polymers include, but are not limited to poly(ester-imides), polyfluoroalkoxys and poly(amide-imides).

Specific examples representative of the preceding general polymeric categories include specific polymers, such as rayon, polypropylene, nylon, epichlorohydrin, viton, chloroprene, silicone, polyacrylonitrile, methyl methacrylate monomers, hydroxyethyl methacrylate trimers, diphenylmethane diisocyanate, hydroxyethyl methacrylate, polyacetylene, poly-p-phenylene, polypyrrole, polyaluminophthalocyanine fluoride, polyphthalocyanine siloxane, polyphenylene sulfide, poly(methylmethacrylate), polyarylethers, polyarylsulfones, polysulfones, polybutadiene, polyether sulfones, polyethylene, polypropylene, polymethylpentene, polyphenylene sulfides, polystyrene and acrylonitrile copolymers, polyvinyl chloride, polyvinyl acetate, poly (vinyl butyral) (PVB), poly(ester-imide), polyfluoroalkoxy and poly(amide-imide), silicones, and copolymers thereof.

In accordance with the present disclosure, fluoroelastomers can be suitable materials for use as the host matrix material as described in detail in U.S. Pat. No. 4,257,699 to Lentz, U.S. Pat. No. 5,017,432 to Eddy et al., and U.S. Pat. No. 5,061,965 to Ferguson et al., which are hereby incorporated by reference in their entirety. As described therein, such suitable fluoroelastomers include, but are not limited to, copolymers of terpolymers, and tetrapolymers of vinylidenefluoride hexafluoropropylene, tetrafluoroethylene, and cure site monomers (believed to contain bromine) known commercially under various designations as VITON A, VITON E60C, VITON E430, VITON 910, VITON GH, VITON GF and VITON F601C (E. I. DuPont deNemours, Inc., Wilmington, Del.). Other commercially available materials suitable for use herein include FLUOREL2170, FLUOREL 2174, FLUOREL 2176, FLUOREL 2177 and FLUOREL LVS 76 (3M Company, Minneapolis, Minn.). Additional suitable commercially available materials include AFLAS a poly/propylene-tetrafluoroethylene) copolymer, FLUOREL II a poly (propylene-tetrafluoroethylene-vinylidenefluoride) terpolymer both also available from 3M Company. Also, the Tecnoflons identified as FOR-60KIR, FOR-LHF, N. Mex., FOR-THF, FOR-TFS, TH, TN505 are available from Ausimont Chemical Co.

Moreover, if a suitable elastomeric matrix is desired for use herein, a silicone, fluorosilicone or polyurethane elastomer can provide the polymer matrix. Typical specific materials include Hetron 613, Arpol 7030 and 7362 available from Oshland Oil, Inc., Dion Iso 6315 available from Koppers Company, Inc. and Silmar S-7956 available from Vestron Corporation. Other materials can be added to the polymer to provide properties such as corrosion or flame resistance as desired. In addition, the polymer phase can contain other fillers such as calcium carbonate, alumina, silica, and a pigment to provide a certain color or lubricants to reduce friction (e.g., in sliding contacts). Further additives to alter the viscosity during processing, surface tension, or to assist in bonding the composition of the present disclosure to the other materials can be added. Further, porous or non-porous, closed or open cell foams can be employed as the polymer phase by use of suitable blowing or foaming agents during processing that are known in the art. Naturally, if the fiber or resulting particulate filler has a polymer sizing or surface treatment applied to it, a compatible polymer should be selected or, alternatively, if a particularly desired polymer matrix is selected a compatible sizing or surface treatment for the filler should be used. For example, if an epoxy resin is being used, it would be appropriate to add an epoxy sizing to the fiber to promote adhesion between the filler and matrix for the case where high strength is desired in addition to electrical conductivity.

Alternate suitable polymeric compounds include, but are not limited to polysilylenes doped with arsenic pentafluoride, iodine, perchlorates, and boron tetrafluorides.

In another aspect of the present disclosure, the electrically conductive material can be a metallic material or metal containing material and can have metallic or magnetic properties. Suitable metallic material includes, but is not limited to, iron containing carbon black, metal particles (e.g., nickel, iron, cobalt, silver, gold, aluminum, etc., oxides thereof, and mixtures thereof), magnetic alloys (e.g., permaloy, cobalt, molybdenum permaloy and the like), and any suitable magnetic particle, such as soft ferrite, hard ferrite (e.g., strontium, lead, barium), neodymium iron boride, nickel, and the like. The metallic material can be compatible with a host matrix material, can be stable under compounding and device manufacturing processes, and can show magnetization at the desired working temperature can be used.

The metallic material can have any suitable particle size (e.g., 1 nanometer to 10 microns) and shape (e.g., such as spherical, round, or cylindrical, tubes, flakes, or mixture of sizes and shapes, which can include corresponding powders) to render the desired property, such as magnetic, to the resulting composition. Nanostructured particles, for example, but not limited to; carbon, boron nitride, boron carbon nitride, silicon, doped silicon, etc. in forms such as nanotubes, nanowires, nanodots, and the like can be used in the present disclosure. The metallic material can be present in the composition in any desired or effective amount, such as from about 0.015% to about 500% by weight, for example less than about 200%, and as a further example less than about 50% by weight relative to the total weight of the composition. Consideration of the optimum ratio can involve the tradeoff amongst magnetic effect, electrical resistivity, field or environmental stability, loss of mechanical strength of the composite, increase in density and cost. The metallic material can be added to a host matrix material by, for example, high shear blend mixing.

In accordance with the present disclosure, the choice of electrically conductive material and/or host matrix material should take into account processing temperatures associated in producing the final product. For example, if ferrite and pyrrolized carbon-based materials are used combined at high temperature with a high temperature host matrix material, such as a ceramic material, then the final conductivity of that composition can be increased by further pyrolization processing of the partially pyrrolized carbon-based material upon exposure to a higher temperature than the temperature that the pyrrolized carbon-based material was originally manufactured. Moreover since magnetic properties of the ferrite also can be altered by, for example, oxidization at the high process temperatures inert atmospheres, such as argon, nitrogen, vacuum and the like can be used during the high temperature processes to prevent unwanted oxidation, for example of the carbon or iron containing constituents. Alternately, if the high temperature processing occurs in a reducing atmosphere, reduction of the ferrite can result in even different magnetic properties. In addition, potential interactions of the ferrite and carbon-based material should be taken into account as the combination can result in higher or lower resulting resistivities. For example, in situations where the highest processing temperatures can be used in production of a composition, then other materials should be chosen with corresponding high conductivities.

In an aspect of the present disclosure, the electrically conductive material and/or the host matrix material can be coated with a conductive polymer. The coating can comprise a mixture of from about 2 polymers to about 7 polymers. In an aspect of the disclosure, the mixture can be of 2 polymers that are not in close proximity in the triboelectric series. In another aspect of the disclosure, the mixture can be of 2 or more polymers that phase separate upon during of the host solvent or during polymerization cross linking.

The conductive polymer can be an organic polymer of a polyacetylene, a polypyrrole, a polythiophene, a poly(p-phenylene sulfide), styrene polymer, polyaniline, and which polymer in embodiments can contain a dopant. Polyaniline can possess a weight average molecular weight $M_w$ of from about 10,000 to about 400,000, for example from about 20,000 to about 100,000, and as a further example from about 22,000 to about 75,000. Moreover, a $M_w/M_n$ ratio can be from about 1.4 to about 2.

The conductive polymer can be present in an amount from about 0.1% to about 70% by weight, for example from about 2% to about 30%, and as a further example from about 5% to about 20% by weight based upon the total weight of the coating. Because the relatively high cost of the conductive polymer can be a concern, in order to achieve a low cost composite it is often possible to use the lowest amount of the conductive polymer in the composites to achieve the desired combination of properties.

The coating can be a polymer selected from polyvinylidenefluoride, polyethylene, polymethyl methacrylate, polytrifluoroethylmethacrylate, copolyethylene vinylacetate, copolyvinylidenefluoride, tetrafluoroethylene, polystyrene, tetrafluoro ethylene, polyvinyl chloride, polyvinyl acetate, polymethyl methacrylate, polystyrene, polytrifluoroethyl methacrylate, and mixtures thereof. The coating can comprise a mixture of polymethyl methacrylate and polytrifluoroethyl methacrylate.

A process for coating can comprise mixing the electrically conductive material and/or the host matrix material with a mixture of monomer, conductive polymer, and initiator, optional chain transfer agent and optional crosslinking agent. The monomer can be polymerized by heating at a temperature of from about 30° C. to about 200° C., and for example from about 60° C. to about 100° C., optionally for a period from about 1 minutes to about 5 hours, and for example from about 30 minutes to about 48 hours.

The monomer utilized in the process can be selected from styrene, α-methyl styrene, p-chlorostyrene, monocarboxylic acids and derivatives thereof; dicarboxylic acids with a double bond and derivatives thereof; vinyl ketones; vinyl naphthalene; unsaturated mono-olefins; vinylidene halides; N-vinyl compounds; fluorinated vinyl compounds; and mixtures thereof. In an aspect of the present disclosure, the monomer can be selected from acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile and acrylamide; maleic acid, monobutyl maleate, dibutyl maleate; vinyl chloride, vinyl bromide, vinyl fluoride, vinyl acetate and vinyl benzoate; vinylidene chloride; pentafluoro styrene, allyl pentafluorobenzene, N-vinyl pyrrole, trifluoroethyl methacrylate; and mixtures thereof.

The initiator can be selected from azo compounds, peroxides, and mixtures thereof. The initiator can be present in an amount from about 0.1 to about 20% by weight, and for example from about 0.5% to about 10% by weight of the monomer mixture. The initiator can be selected from 2,2'-azodimethylvaleronitrile, 2,2'-azoisobutyronitrile, azo-bis (cyclohexane)nitrile, 2-methylbutyronitrile, benzoyl peroxides, lauryl peroxide, 1-1-(t-butylperoxy)-3,3,5-trimethyl cyclohexane, n-butyl-4,4-di-(t-butylperoxy)valerate, dicumyl peroxide, and mixtures thereof.

The crosslinking agent can be selected from compounds having two or more polymerizable double bonds, such as divinylbenzene, divinylnaphthalene, ethylene glycol diacrylate, ethylene glycol dimethylacrylate, divinyl ether, divinyl sulfite, divinyl sulfone, and mixtures thereof.

The coating can contain a conductive polymer, for example, a conductive polyaniline, of a doped (or complexed) form of polyaniline with an organic acid, such as a sulfonic acid. The emeraldine salt of polyaniline, a green-black powder with no odor, is commercially available as Versicon from Monsanto Company of St. Louis, Mo., reference U.S. Pat. No. 4,798,685, the disclosure of which is totally incorporated herein by reference; U.S. Pat. No. 5,069,820, the disclosure of which is totally incorporated herein by reference, and U.S. Pat. No. 5,278,213, the disclosure of which is totally incorporated herein by reference, and illustrates aggregates of small primary particles of an average size of 0.1 to 0.2 micron with a bulk conductivity of 1 to 10 $(\text{ohm-cm})^{-1}$. XICP-OS01 is available from Monsanto Company as the soluble form of the emeraldine salt of a polyaniline at a concentration from about 40% to about 60% by weight, and typically 50% in a mixture of about 27% to about 40% of butyl cellusolve and from about 0 to about 33% of xylenes. The reported conductivities for the doped or complexed forms of the polyaniline polymer are, for example, 1 $(\text{ohm-cm})^{-1}$ for the volume conductivity and about $10^{-2}$ to about $10^{-3}$ $(\text{ohm-square})^{-1}$ for the surface conductivity as conducted on films with a thickness of 3 mils or approximately 75 microns. Further examples of conductive polymers that can be selected are: XICP-OS06 available from Monsanto Company as the soluble form of the emeraldine salt of polyaniline at a concentration of about 9% to about 18%, in a mixture of about 50% to about 70% of tetrahydrofuran, about 6% to about 14% of butyl cellusolve, about 0 to about 11% of xylenes, and about 7% to about 14% of dopants added to induce conductivity; Conquest XP 1000 a water based dispersion of polypyrrole and polyurethane, available from DSM Research, The Netherlands, with a solids content of about 19% to about 21% and a reported conductivity of higher than about 0.2 $(\text{ohm-cm})^{-1}$; CONQUEST XP 1020 the dry conductive powder of the aforementioned material with a Minimum Film Forming Temperature (MFT) of 50° C., and a drying temperature from about 60° C. to about 120° C.; BAYTRON a dark blue aqueous solution of 3,4-polyethylene dioxythiophene polystyrene sulfonate (PEDT/PSS) containing about 0.5% by weight of PEDT and about 0.8% by weight of PSS, available from Bayer Corporation, and wherein surface conductivities of about $10^{-3}$ to about $10^{-5}$ (ohm-square) or higher can be achieved with this material; CPUD II an aqueous conductive polyurethane dispersion that can form a conductive film with surface conductivities of about $10^{-5}$ to about $10^{-8}$ (ohm-cm) at a voltage of 100 volts using a Series 900 Megohmer; dispersions of polyaniline in different binders available as Corrpassive lacquer systems, for example, ORMECON™ CSN available as an anticorrosion coating, and wherein the specific conductivity of some highly conductive ORMECON™ lacquers can achieve values of up to about 100 $(\text{ohm-cm})^{-1}$; WPPY, available from Eeonyx Corporation, a proprietary composition of polypyrrole in water at a concentration of about 1 to about 6 percent solids and a reported bulk conductivity of about 0.01 to about 0.001 $(\text{ohm-cm})^{-1}$ as measured according to the ASTM F84 and D257; intrinsically conductive polymer additives based on polypyrrole and polyaniline and available as EEONOMER by Eeonyx as thin layers of polypyrrole and polyaniline on the surface of carbon blacks and with conductivities of up to about 40 $(\text{ohm-cm})^{-1}$; and Neste Conductive Polymers—NCP, available from Neste Oy Chemicals, as conductive polymer compositions based on polyaniline that can be solution or melt processed and can achieve conductivities of about 1 $(\text{ohm-cm})^{-1}$.

The concept of bulk resistivity of a material is an intrinsic property of the material and can be determined from a sample of uniform cross-section. The bulk resistivity, expressed in units of ohms-cm, is the mathematical product of the d.c. resistance of such a sample and the cross-sectional area through which the current can flow divided by the length of the sample through which the current path is established. The bulk resistivity can be very stable or alternatively can vary with the applied voltage. In contrast, the surface or sheet resistivity (frequently expressed as ohms per square) is not an intrinsic property of a material but can depend upon the thickness of the matrix and is relative to the bulk resistivity divided by the thickness of the matrix.

As noted, the bulk resistivity and the surface resistivity of a material can be stable (i.e. ohmic) over a wide range of applied voltages or can show a linear or non-linear dependency (i.e. non-ohmic) upon the applied field. Alternately, the resistivities can be stable (meaning that the resistivity does not increase or decrease under different levels of applied voltage) when subjected to a portion of the range of applied voltages and be unstable when other, for example higher or lower, applied voltages are used. In general, a combination of filler types can be used to obtain ohmic behavior in the resulting composite. For example a combination of carbon particles or carbon nanostructured fillers when used in combination with a conductive polymer in a host polymer to comprise a conductive composite can exhibit stable resistivities over a wide range of applied voltages. In certain applications, for example resistive heaters where current passing through a resistive element produces heat in proportion to the current flowing through the element and the applied voltage, the stability of the rate of heat produced independent of the present state temperature of the element is an important consideration. May conventional resistive heating devices exhibit resistance changes that depend upon the present state temperature, which is defined as the instantaneous temperature that they reside during the heating/cooling cycle. Thereby, resistance values can decrease during a heating cycle causing higher current flows that can if left uncontrolled lead to burnout and self-destruction of the device. In this example, stabilization of the resistance to fluctuation in temperature and improve the performance of resistive heater elements and the related devices.

Similarly, resistivities of ionic salt containing conductive composites can vary with environmental relative humidity (RH) depending upon the RH to which they are exposed. In this case, a combination of carbon particles or carbon nanostructured fillers when used in combination with a conductive polymer or a conductive salt in a host polymer to comprise a conductive composite can exhibit stable resistivities over a wide range of RH.

According to an aspect of the present disclosure, the resistivity of the composite varies approximately proportionately to the bulk resistivity of the individual fibers and the volume fraction of the fibers in the matrix. These two parameters can be selected independently. For any particular fiber or corresponding powder resistivity, the resistivity of the coated matrix can be varied over roughly an order of magnitude by changing the volume fraction of the fiber or corresponding powder forms. Thus, the bulk resistivity of those fibers or powders can be chosen at least to be within approximately three orders of magnitude or less, but below the bulk resistivity desired in the final composite. When the fibers or corresponding powder forms are mixed with the insulating matrix-forming binder in an amount above the percolation threshold, the resistivity of the resulting matrix can change in an approximately linear manner, for example at loadings significantly exceeding the initial point where percolation occurs. Fine tuning of the final resistivity can be accurately controlled by this approximately linear change in the resistivity—filler loading relationship. Fibers, which can be in powder form that can be used include fibers having a bulk resistivity from about $10^{-2}$ ohms-cm to about $10^{6}$ ohms-cm. These resistivities can permit preparation of films having electrical sheet resistivities from about $10^{2}$ ohms/square to $10^{13}$ ohms/square.

In another aspect of the present disclosure, powder fibers can be dispersed in a polymer binder at a volume loading sufficiently above the percolation threshold so that the resistivity of the matrix can be low. The fibers can be at least present in an amount from about 15 volume percent to about 85 volume percent based on volume of the binder, and for example in an amount from about 35 volume percent to about 65 volume percent.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "a fiber" includes two or more different fibers. As used herein, the term "include" and its grammatical variants are intended to be non-limiting, such that recitation of items in a list is not to the exclusion of other like items that can be substituted or added to the listed items.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. An electrical component comprising:

an electrically conductive composition comprising a pyrrolized or partially pyrrolized carbon-based material coated with a coating comprising a conductive polymer and a polymer formed from at least one monomer selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile, acrylamide, maleic acid, monobutyl maleate, dibutyl maleate, vinyl chloride, vinyl bromide, vinyl fluoride, vinyl acetate, vinyl benzoate, vinylidene chloride, pentafluoro styrene, allyl pentafluorobenzene, N-vinyl pyrrole, trifluoroethyl methacrylate, and mixtures thereof, wherein the conductive polymer is polyaniline, wherein the polyaniline possesses a weight average molecular weight from about 20,000 to about 100,000, and wherein the partially pyrrolized carbon-based material has a DC volume resistivity from about $1\times10^{-5}$ to about $1\times10^{13}$ ohm-cm.

2. The component of claim 1, wherein the electrical component is selected from the group consisting of an intermediate transfer belt, bias transfer belt, bias charging belt, bias transfer roll, bias charging roll, paper drive roll, paper drive belt, cleaner blade, cleaner brush, developer roll, developer belt, fuser belt, pre-heater belt, mid-heater belt, resistive heater, fuser roll, pressure roll, and donor roll.

3. The component of claim 1, wherein the electrically conductive composition is stable at a temperature from about −50° C. to about 300° C.

4. The component of claim 1, wherein the pyrrolized carbon-based material is pyrrolized organic polymer-based fiber, particle, or resin in a powder form.

5. The component of claim 1, wherein the pyrrolized carbon-based material is pyrrolized polyacrylonitrile fiber, particle, or filler in a powder form.

6. The component of claim 1, wherein the pyrrolized carbon-based material is in a form selected from the group consisting of a fine powder of spheres, near spheres, flakes, needles, shards, rods, tubes, and mixtures and blends thereof.

7. The component of claim 1, wherein the electrically conductive composition further comprises a host matrix.

8. The component of claim 1, wherein the electrically conductive composition comprises about 0.1% to about 99% by weight pyrrolized carbon-based material.

9. The component of claim 1, wherein the pyrrolized carbon-based material is partially pyrrolized.

10. An electrically conductive material comprising a pyrrolized or partially pyrrolized carbon-based material coated with a coating comprising a conductive polymer and a polymer formed from at least one monomer selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile, acrylamide, maleic acid, monobutyl maleate, dibutyl maleate, vinyl chloride, vinyl bromide, vinyl fluoride, vinyl acetate, vinyl benzoate, vinylidene chloride, pentafluoro styrene, allyl pentafluorobenzene, N-vinyl pyrrole, trifluoroethyl methacrylate, and mixtures thereof, wherein the conductive polymer is polyaniline, wherein the polyaniline possesses a weight average molecular weight from about 20,000 to about 100,000, and wherein the partially pyrrolized carbon-based material has a DC volume resistivity from about $1\times10^{-5}$ to about $1\times10^{13}$ ohm-cm.

11. The material of claim 10, wherein the pyrrolized carbon-based material is pyrrolized organic polymer based fiber, particle, or resin in a powder form.

12. The material of claim 10, wherein the pyrrolized carbon-based material is pyrrolized polyacrylonitrile fiber or filler in a powder form.

* * * * *